US006103021A

United States Patent [19]

Sekine et al.

[11] Patent Number: 6,103,021

[45] Date of Patent: Aug. 15, 2000

[54] METHOD OF PREPARING RAW MATERIAL POWDER FOR PERMANENT MAGNETS SUPERIOR IN MOLDABILITY

[75] Inventors: Shigenobu Sekine, Tokyo; Hiroji Sato, Minato-Ku, both of Japan

[73] Assignees: Kawasaki Teitoku Co., Ltd.; Sanei Kasei Co., Ltd; Komeya, Inc., all of Tokyo, Japan

[21] Appl. No.: 09/112,288

[22] Filed: Jul. 9, 1998

Related U.S. Application Data

[63] Continuation of application No. 08/779,218, Jan. 6, 1997, Pat. No. 5,865,873.

[30] Foreign Application Priority Data

Jan. 10, 1996 [JP] Japan ..... 8-2517

[51] Int. Cl.[7] ..... B22F 9/00

[52] U.S. Cl. ..... 148/105; 75/348; 75/349

[58] Field of Search ..... 148/104, 105; 75/348, 349

[56] References Cited

U.S. PATENT DOCUMENTS 5,849,109 12/1998 Ikeda ..... 148/104

5,865,873 2/1999 Sekine et al. ..... 75/348

FOREIGN PATENT DOCUMENTS 58-147502 9/1983 Japan ..... 75/348

5-179313 7/1993 Japan ..... 75/349

*Primary Examiner*—George Wyszomierski

*Attorney, Agent, or Firm*—Pillsbury Madison & Sutro LLP

[57] ABSTRACT

The present invention is directed to provide a method of preparing a raw material powder for permanent magnets superior in moldability, especially in moldability and productivity of bonded magnets. The method comprises subjecting an acicular iron powder having an aspect ratio of not smaller than 5:1 to heating at 800–900° C. in fluidized state with a gas stream containing no oxygen until the acicular iron powder is transformed into a columnar shape iron powder having an aspect ratio of not larger than 3:1, a die-like shape iron powder or a spherical shape iron powder. The acicular iron powder may contain or may be attached by such a component effective for improving magnetic properties as a rare earth element metal, a rare earth element metal oxide, boron, cobalt and nickel.

1 Claim, No Drawings

METHOD OF PREPARING RAW MATERIAL POWDER FOR PERMANENT MAGNETS SUPERIOR IN MOLDABILITY

This is a continuation of application Ser. No. 08/779,218, filed Jan. 6, 1997 now U.S. Pat. No. 5,865,873.

BACKGROUND OF THE INVENTION

1. Filed of the Invention

The present invention relates to a method of preparing raw material powder for permanent magnets superior in moldability, especially in moldability and productivity with regard to bonded magnets.

2. Description of the Prior Art

Molded permanent magnets include sintered magnets and bonded magnets. Sintered magnets are prepared by sintering a raw material powder at a high temperature. Bonded magnets are prepared by binding raw material powder for magnets with such binders as rubbers and plastics. Bonded magnets are used widely, since the production process includes no sintering step, provides precision workpieces, eliminates machining like polishing, yields impact-resistant products and is suitable for mass-production of complexly molded products. As for the molding process, those used in plastics industries as rolling, extruding and injection are employed. The raw material powder preferably as much as possible has a spherical shape and a uniform particle size, in order to facilitate the molding process and improve the productivity. For example, in case of operating an injection molding machine, the more the powder for raw material of magnets approaches spherical shape and uniform particle size, the more the injection pressure decreases. Thus, it becomes possible to increase the productivity by increasing the rotation speed of the injection molding machine, and/or decrease the amount of molding auxiliary agents.

Raw materials for permanent magnets are developing remarkably, and Neodymium-Iron-Boron permanent magnets have being praised for the superior magnetic properties. JP-B-61-34242 discloses a magnetically anisotropic sintered magnet having a Fe . B . Nd components, and the production process includes providing a cast alloy of the above components and pulverizing mechanically the cast alloy to obtain a raw material powder.

However, the process has such drawbacks as requiring a pulverizing cost, and fluctuation in performance of products depending on production batches. The raw material powder has a broad range of particle size distribution due to the mechanical pulverization. The mechanically pulverized powder has little disadvantage as a raw material for sintered magnets. However, as a raw material for bonded magnets, the powder necessitates a higher injection pressure, and it is difficult to increase the productivity by increasing rotating speed of injection molding machines.

Further, a raw material powder for permanent magnets is proposed which is obtainable by reducing an acicular crystal of FeOOH (goethite) in a hydrogen gas stream at 300–600° C. to turn to an acicular iron powder and dispersing in the iron powder such components for improving magnetic properties as a rare earth element like neodymium (Nd), boron and cobalt. However, since the starting raw material FeOOH (goethite) is an acicular crystal having an aspect ratio of from 5:1 to around 10:1, the obtained acicular iron powder has also an aspect ratio of larger than 5:1, which causes inferior moldability of the iron powder when used for production of bonded magnets.

SUMMARY OF THE INVENTION

The present invention is directed to provide a method of preparing a raw material powder for permanent magnets superior in moldability, especially in moldability and productivity of bonded magnets.

According to the present invention, the method of preparing raw material powder for permanent magnets superior in moldability is characterized by subjecting an acicular iron powder having an aspect ratio of not smaller than 5:1 to heating at 800–900° C. in fluidized state with a gas stream containing no oxygen and continue the heating until the acicular iron powder is transformed into a columnar shape iron powder having an aspect ratio of not larger than 3:1, a die-like shape iron powder or a spherical shape iron powder. The acicular iron powder is obtained by subjecting an acicular crystal of FeOOH (goethite) to reduction by heating at 300–600° C. in fluidized state with a hydrogen gas stream, and the resulted acicular iron powder has a length (longitudinal) of not longer than 10 $\mu$m and a width (lateral) of around 1/10–1/5 thereof. The acicular iron powder may contain or may be accompanied by such components effective for improving magnetic properties as rare earth element metals, rare earth element metal oxides, boron, cobalt and nickel.

DESCRIPTION OF THE PREFERRED EMBODIMENTS

An acicular iron powder is settled as the starting raw material, because acicular iron powder is rather uniform in size, and obtainable columnar shape iron powder having an aspect ratio of not larger than 3:1, die-like shape iron powder or spherical shape iron powder has a relatively uniform particle size. When an acicular iron powder having an aspect ratio of larger than 5:1 is subjected to heating at 800–900° C., the powder is solution annealed and, due to the surface tension, changes the shape successively with the course of time firstly to columnar shape iron powder having an aspect ratio of not larger than 3:1, then to die-like shape iron powder and finally to spherical shape iron powder.

It is important to proceed the heating of the powder in fluidized state with a gas stream containing no oxygen. Due to the heating in a fluidized state, the solution annealed iron powder exist without causing mutual adhesion and hold respective independent shapes. Since no pulverizing step is included in the present method, the resulting iron powder having a columnar shape having an aspect ratio of not larger than 3:1, die-like shape or spherical shape maintains a relatively uniform particle size.

Hydrogen gas stream is employed usually as a gas stream containing no oxygen for heating the acicular iron powder in fluidized state at 800–900° C., however, nitrogen gas stream or a hydrogen gas stream containing nitrogen may be used when nitrogen is desired to be contained as a component of the product.

When the temperature for fluidized heating of the iron powder is lower than 800° C., the solution annealing of the acicular iron powder is not so sufficient as to accomplish the object of the invention or the heating requires a prolonged hours unallowable industrially. When the temperature for fluidized heating is higher than 900° C., the fluidizing iron powder tends to form aggregate due to mutual fusion. The length of heating hours has a reverse proportional relationship with the processing temperature.

When an acicular iron powder having an aspect ratio of 10:1 is treated at 800° C., columnar shape powder having an aspect ratio of not larger than 3:1 is obtained after about 1–5 hours, die-like shape powder is obtained after about 3–10 hours, and spherical shape powder is obtained after about 8–20 hours. When an acicular iron powder is treated at 900°

C., spherical shape powder is obtained after about 7–15 hours. For the commercial operation, the temperature of heat treatment and the heating hours may be determined in consideration of energy cost for heating and productivity based on preliminary tests.

Such components effective for improving magnetic properties as rare earth element metals, rare earth element metal oxides, boron, cobalt and nickel may be incorporated in FeOOH (goethite) or in an acicular iron powder or in an iron powder according to the invention being columnar shape of an aspect ratio of not larger than 3:1, die-like or spherical shape. In any incorporating method, the improving component diffuses in the surface layer of the iron powder during the succeeding heat treatment to effectuate the improvement.

Amounts of the improving component to be incorporated in the raw material may be determined arbitrary in accordance with magnetic properties desired, and the method of the present invention is applicable to any kind and amount of the improving component. Rare earth elements may be used not only in pure form but also in mixed forms or in alloys with iron or cobalt. Further, boron is not restricted to the pure element but ferroborons and others containing Al, Si, C, etc. are usable. The improving component to be incorporated is preferably in a form of powder having an average particle size of micron or submicron order.

The raw material powder for permanent magnets obtained according to the present invention is a readily oxidizable fine powder having an average particle size of smaller than 2 $\mu$m and is flammable in the air, for which an oxidation-preventing coating is preferably applied before the powder product is discharged out of the production facility or just after the discharge. As for the oxidation-preventing coating, such inorganic compounds as aluminum phosphate, alumina, aluminum hydroxide, aluminum nitrate and aluminum acetate or organic compounds like silicone oils and film-forming synthetic resins are usable. Because of the heat resistance, the organic compounds must be applied to the powder after the fluidized heating at 800–900° C., however, the inorganic compounds can be applied during at any step of the production. By heating at 800–900° C., the aluminum hydroxide, aluminum nitrate and aluminum acetate turn to aluminum oxide.

The raw material powder for permanent magnets obtainable according to the present invention is used for producing sintered magnets or bonded magnets by use of known production methods. Especially in case of producing bonded magnets by injection molding, the raw material powder brings about decreased injection pressure and the productivity can be improved by increasing the rotating speed (RPM: Rotation Per Minute) of injection molding machines in comparison with using an acicular crystal raw material. The present invention will be explained in detail by reference of Examples, however, the invention never be restricted to the Examples.

COMPARATIVE EXAMPLE 1

An acicular crystal of FeOOH having about 1 $\mu$m length and an aspect ratio of about 10:1 was heated at 400° C. in a hydrogen gas stream for 6 hours to obtain an acicular iron powder having about 1 $\mu$m length, and an aspect ratio of about 10:1.

EXAMPLES 1–3

The acicular iron powder obtained in Comparative Example 1 was heated at 800° C. in fluidized state with a hydrogen gas stream for hours appropriate to obtaining a columnar shape iron powder having an aspect ratio of about 2.5:1 (Example 1), a die-like shape iron powder (Example 2) and a spherical shape iron powder (Example 3). Relationship between the heating hour and the shape of powder is shown in Table 1.

TABLE 1

| | treating temperature ° C. | treating time hr | Shape of powder |
|---|---|---|---|
| Comp. Example 1 | | 0 | acicular |
| Example 1 | 800 | 1 | columnar |
| Example 2 | 800 | 3 | die-like |
| Example 3 | 800 | 8 | spherical |

To each of the raw material powder for permanent magnets obtained in Comparative Example 1 and Examples 1–3 was added 8 wt % of a nylon resin for bonded magnets and a molding auxiliary agent (silica powder) of the amount mentioned in Table 2, the obtained mixture was injection molded in a form of bonded magnet (1 cm×1 cm×1 cm), and the molded form was magnetized. The amount of molding auxiliary agent added, rotating speed of injection machine and injection pressure (ratio to the maximum injection pressure 50 Kg/cm$^2$ ) are mentioned in Table 2.

TABLE 2

| | Shape of powder | Molding agent wt % | Molding machine rpm | Injecting pressure % |
|---|---|---|---|---|
| Comp. Example 1 | acicular | 1 | 120 | 98 |
| Example 1 | columnar | 1 | 123 | 98 |
| Example 2 | die-like | 0.5 | 125 | 95 |
| Example 3 | spherical | 0.2 | 130 | 95 |

COMPARATIVE EXAMPLE 2

To the articular iron powder prepared in Comparative Example 1 were added a powder of neodymium metal, a powder of boron and a powder of cobalt as components for improving magnetic properties so as to have the resulting content of Nd: 8 wt %, B: 5 wt %, Co: 10 wt % and acicular iron powder: rest, and the resulting powder was maintained at 500° C. for 20 hrs to disperse the added components in the surface layer of the acicular iron powder.

EXAMPLES 4–6

The acicular iron powder of Comparative Example 2 containing the components for improving magnetic properties was heated at 900° C. in a fluidized state with a hydrogen gas stream for hours appropriate to obtaining a columnar shape iron powder having an aspect ratio of about 2.5:1 (Example 4), a die-like shape iron powder (Example 5) and a spherical shape iron powder (Example 6). Relationship between the heating hour and the shape of iron powder is shown in Table 3.

TABLE 3

| | treating temperature ° C. | treating time hr | Shape of powder |
|---|---|---|---|
| Comp. Example 2 | | 0 | acicular |
| Example 4 | 900 | 0.5 | columnar |
| Example 5 | 900 | 3 | die-like |
| Example 6 | 900 | 7 | spherical |

To each of the raw material powder for permanent magnets obtained in Comparative Example 2 and Examples 4–6 was added 8 wt % of a nylon resin for bonded magnets and a molding auxiliary agent (silica powder) of the amount mentioned in Table 4, and the obtained mixture was injection molded in a form of bonded magnet (1 cm×1 cm×1 cm), and the molded form was magnetized. The amount of molding auxiliary agent added, rotating speed of injection machine and injecting pressure (ratio to the maximum injection pressure 50 $Kg/cm^2$ ) are mentioned in Table 4.

TABLE 4

| | Shape of powder | Molding agent wt % | Molding machine rpm | Injecting pressure % |
|---|---|---|---|---|
| Comp. Example 2 | acicular | 1 | 120 | 98 |
| Example 4 | columnar | 1 | 123 | 98 |
| Example 5 | die-like | 0.5 | 125 | 95 |
| Example 6 | spherical | 0.2 | 130 | 95 |

As shown by table 2 and table 4, the raw material iron powder for permanent magnets according to the present invention being a columnar shape having an aspect ratio of not larger than 3:1, a die-like shape or a spherical shape enables, in comparison with using an acicular iron powder without transformation, production of bonded magnets with less requirement for molding auxiliary agents and injection pressure, and the productivity can be improved by increasing rotating speed of injection molding machines.

What is claimed is:

1. A method of preparing raw material powder for permanent magnets superior in moldability, which comprises steps of subjecting an acicular iron powder having an aspect ratio of not smaller than 5:1 to heating at 800–900° C. in a fluidized state with a hydrogen gas stream until the acicular iron powder is transformed into a columnar shape iron powder having an aspect ratio of not larger than 3:1, a dice shaped iron powder or a spherical shape iron powder;

adding at least one component selected from the group consisting of rare earth element metals, boron and cobalt metal to the transformed iron powder; and heating the resulting iron powder until the added component(s) diffuses in the surface layer of the columnar shape iron powder having an aspect ratio of not larger than 3:1, the dice-shaped iron powder or the spherical shape iron powder.

* * * * *